US005957430A

United States Patent [19]

Olson

[11] Patent Number: 5,957,430

[45] Date of Patent: Sep. 28, 1999

[54] MAGNETIZED STAPLE REMOVER

[76] Inventor: Rory Olson, 9111 - 66th Ave. NW., #109, Gig Harbor, Wash. 98332

[21] Appl. No.: 08/931,537

[22] Filed: Sep. 16, 1997

Related U.S. Application Data

[60] Provisional application No. 60/029,635, Oct. 28, 1996.

[51] Int. Cl.[6] ..... B25C 11/00

[52] U.S. Cl. ..... 254/28

[58] Field of Search ..... 254/28

[56] References Cited

U.S. PATENT DOCUMENTS

| | | | |
|---|---|---|---|
| 3,761,057 | 9/1973 | Nembhard et al. . | |
| 3,766,647 | 10/1973 | Steiner . | |
| 3,974,999 | 8/1976 | Bertolet | 254/28 |
| 4,054,263 | 10/1977 | Delia | 254/28 |
| 5,494,260 | 2/1996 | Huang | 254/28 |

FOREIGN PATENT DOCUMENTS

| | | | |
|---|---|---|---|
| WO 91/02627 | 3/1991 | WIPO | B25C 11/00 |

*Primary Examiner*—Robert C. Watson

*Attorney, Agent, or Firm*—Seed & Berry LLP

[57] ABSTRACT

A staple remover, with a plurality of magnets by which staples that have been removed are captured and held until they can be suitably disposed of. The staple remover has a first channel member, with a front end from which prongs extend, and a rear end and a second channel member, smaller in width than the first channel member, with a front end from which prongs extend towards the prongs of the first channel member, and a rear end pivotally attached to the rear end of the first channel member, so that the second channel member fits inside the first channel member. The channel members can move between an open position in which the prongs are separated, to a closed position in which the prongs overlap so as to grasp and remove staples from paper or other material in which they are embedded. There are supporting members attached to the channel members, with two or more magnets attached to the supporting members. In the preferred embodiment, there are wings extending from the left and right sides of each supporting member, and there is one magnet attached to each wing. Preferably, the magnets are disk shaped, are inserted into cylindrical recesses in each wing, and are attached with an adhesive material.

20 Claims, 2 Drawing Sheets

MAGNETIZED STAPLE REMOVER

CROSS-REFERENCE TO RELATED APPLICATION

This application claims priority from U.S. Provisional Patent Application No. 60/029,635, filed on Oct. 28, 1996.

TECHNICAL FIELD

The present invention relates to a staple remover with attached magnets.

BACKGROUND OF THE INVENTION

The present invention is a staple remover with small magnets that are mounted laterally outside of the jaws or prongs of the staple remover and which are retained in recesses in its handles. When the jaws of the staple remover are released after a staple has been removed, the staple is captured by the magnets as it falls out and kept clear of the jaws or prongs of the staple remover. The invention is useful for keeping removed staples out of carpets or other places where they are hard to remove. While there are prior inventions for staple removers, including staple removers with magnets, it will be seen that none are equivalent to the present invention.

U.S. Pat. No. 3,761,057, issued on Sep. 25, 1973, to Roy L. Nembhard and James A. Sinclair, discloses a staple remover with a pair of jaws having wedged-shaped teeth. The instant invention is distinguishable, in that it has magnets to retain the staples after they have been removed.

U.S. Pat. No. 3,766,647, issued on Oct. 23, 1973, to Walter Steiner, discloses a can opener with a rotary or other cutter and a magnet for catching small chips that are cut off as the can is opened. The instant invention is distinguishable, in that it pries staples out of the paper or other material in which they are embedded, rather than cutting through the material.

U.S. Pat. No. 3,974,999, issued on Aug. 17, 1976, to Carol F. Bertolet, discloses a combined staple removing and retrieving device, including a single permanent magnet for retrieving and holding a staples that have been removed. The instant invention is distinguishable, in that it has at least one magnet adjacent to its jaws.

U.S. Pat. No. 4,054,263, issued on Oct. 18, 1977, to Michael Delia, discloses a magnetized staple remover, having two magnetic plates, one attached over an upper jaw, and the other attached below a lower jaw. The instant invention is distinguishable, in that it has at least one magnet laterally spaced from its jaws or prongs for capturing and retaining the captured staples clear of the jaws.

In PCT International Patent Application No. 91/02627, published on Mar. 7, 1991, inventors Douglas A. Callison and Douglas Thieleke, disclose a staple removing device, with a pair of hinged, opposing jaws, and an anvil member in each jaw that can release a staple that has been partially removed by the jaws, or engage the staple simultaneously with the jaws when the staple is first being removed. The instant invention is distinguishable, in that it uses magnets to retain the staples after they have been removed.

None of the above inventions and patents, taken either single or in combination, is seen to describe the instant invention as claimed.

SUMMARY OF THE INVENTION

The present invention relates to a staple remover, with at least one magnet by which staples that have been removed are captured and held clear of the jaws or prongs of the staple remover until they can be suitably disposed of. The staple remover of an exemplary embodiment has a first channel member, with a front end from which prongs extend, and a rear end, and a second channel member smaller in width than the first channel member, with a front end from which prongs extend towards the prongs of the first channel member, and a rear end pivotally attached to the rear end of the first channel member, so that the second channel member fits inside the first channel member. The channel members can move between an open position in which the prongs are separated, to a closed position in which the prongs overlap so as to grasp and remove staples from paper or other material in which they are embedded. There are supporting members attached to the channel members, with two or more magnets attached to the supporting members. In the preferred embodiment, there are wings extending from the left and right sides of each supporting member, and there is one magnet attached to each wing, preferably, four magnets, with one each on the left side of the upper jaw, the right side of the upper jaw, the left side of the lower jaw, and the right side of the lower jaw. Preferably, the magnets are disk shaped and are mounted in cylindrical recesses in each wing by way of an adhesive material.

Accordingly, it is a principal object of the invention to provide a device for removing staples, with magnets to retain the staples clear of the jaws or prongs after they have been removed.

It is another object of the invention to provide a means for keeping staples that have been removed out of carpets or other hard to reach areas.

It is a further object of the invention to provide a magnetized staple remover with a new and improved placement of the magnets.

Still another object of the invention is to provide a staple remover having cylindrical recesses in which disk shaped magnets are placed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE INVENTION

The present invention is a staple remover with a pair of pivotally connected, opposing jaws, with magnets attached alongside of the jaws.

Figure 1:
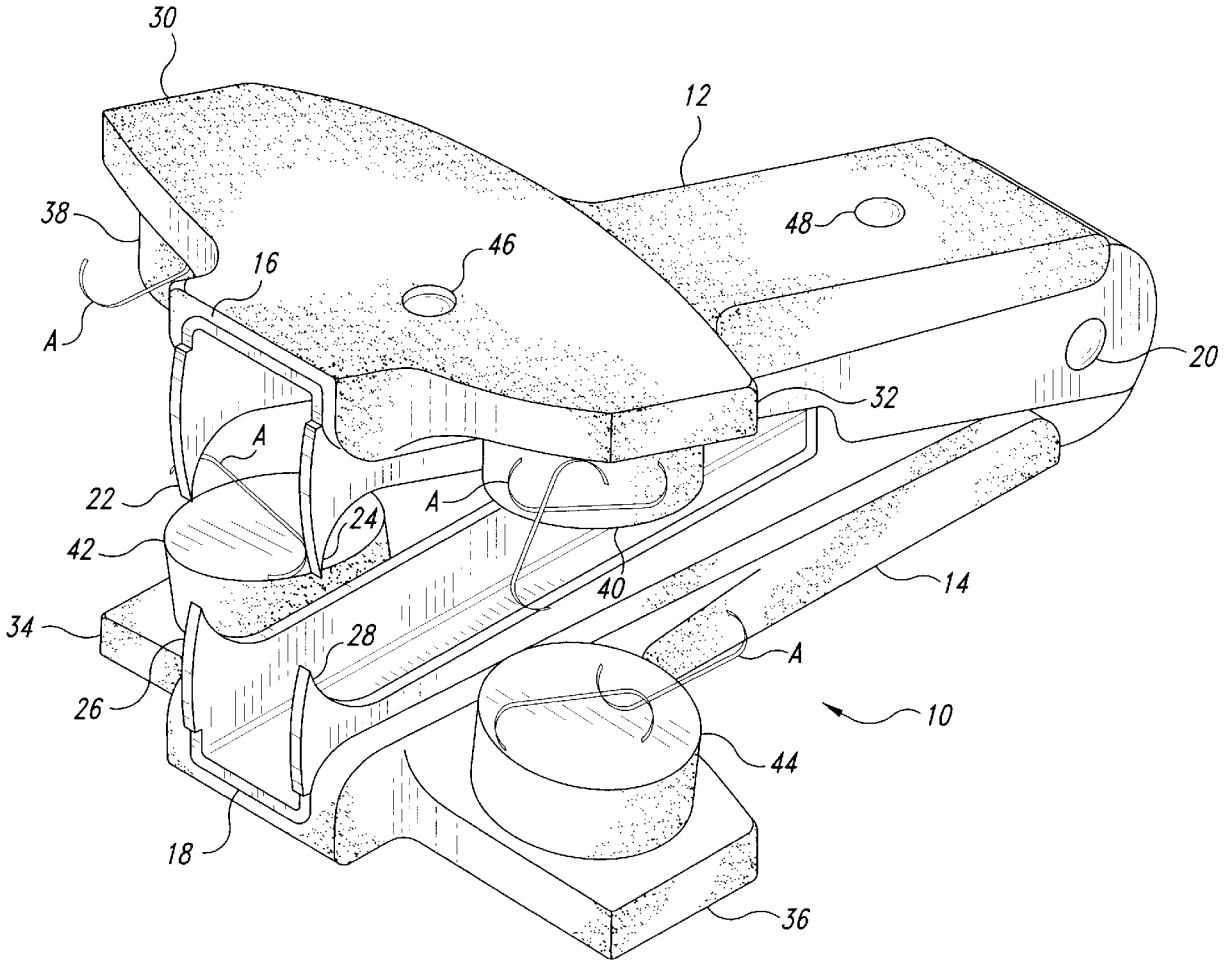
FIG. 1 is a perspective view of an exemplary embodiment of the invention, showing staples clinging to the magnets of the staple remover.

FIG. 1 is a perspective view of the invention 10, showing upper supporting member 12 and lower supporting member 14. Upper channel member or jaw 16 is attached to the upper supporting member 12; lower channel member or jaw 18 is attached to the lower supporting member 14. The upper and lower channel members 16, 18 are connected by pivot 20. Upper left prong 22 and upper right prong 24 extend downwards from the front of the upper channel member 16; lower left prong 26 and lower right prong 28 extend upwards from the front of the lower channel member 18. The channel members 16, 18 and their prongs 22–28 may be brought together so as to overlap by manual pressure against the supporting members 12, 14, so as to remove staples from paper or other material in which they are embedded. An upper left wing 30 and an upper right wing 32 extend from the front of the upper supporting member 12; a lower left wing 34 and a lower right wing 36 extend from the front of the lower supporting member 14. An upper left magnet 38 is attached to the bottom of the upper left wing 30; an upper right magnet 40 is attached to the bottom of the upper right wing 32; a lower left magnet 42 is attached to the top of the lower left wing 34; and a lower right magnet 44 is attached to the top of the lower right wing 36. Staples A that have been removed from the material in which they were embedded are shown attached to the magnets. The magnets attract staples as they are removed, preventing them from falling into hard to reach areas, until they can be removed by hand and placed in a waste receptacle.

Upper front rivet 46 and upper rear rivet 48 attach the upper supporting member 12 to the upper channel member 16. The supporting members 12, 14 and channel members 16, 18 may also be attached by an adhesive material.

Figure 3:
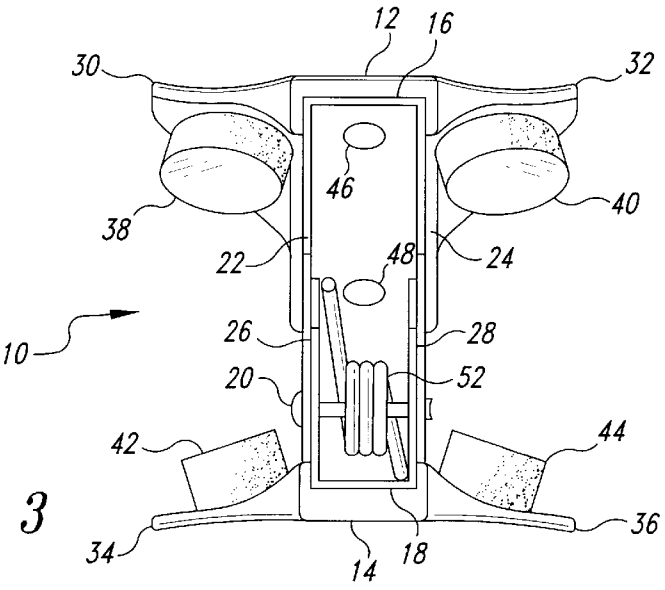
FIG. 3 is a front elevational view of the embodiment of FIG. 1.
Figure 2:
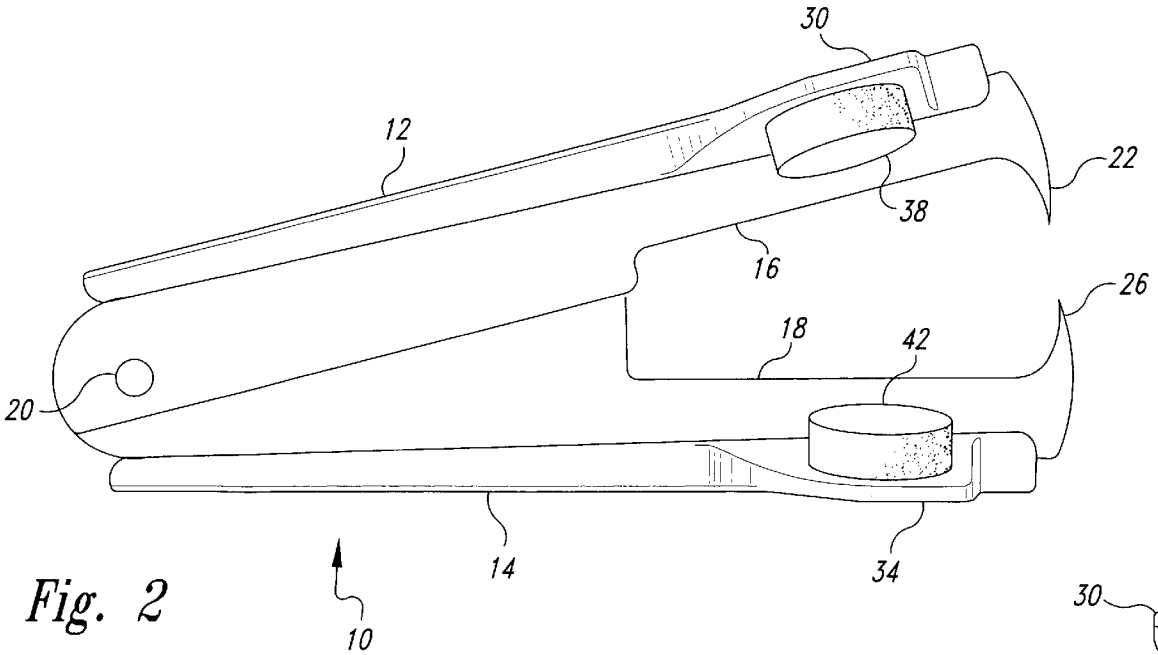
FIG. 2 is a left side elevational view of the embodiment of FIG. 1.

FIG. 2 is a left side elevational view of the invention, with the right side elevational view being symmetrical. FIG. 3 is a front elevational view of the invention, showing front lower rivet 50, and spring 52. FIG. 3 shows more clearly that the upper channel member 16 is slightly wider than, and fits outside, the lower channel member 18. Altematively, the lower channel member 18 may be wider than the upper channel member 16. The spring 52 surrounds the pivot 20 and engages each channel member 16, 18, thus biasing the jaws or prongs 22–28 apart in an open position, while allowing the invention to be closed manually to remove a staple.

The supporting members 12, 14 are preferably made of plastic. Other parts of the invention should be made of metal. The magnets 38–44 are preferably disc shaped, and attached to the wings 30–36 of the supporting members 12, 14 by an adhesive material. There may be shallow cylindrical recesses in each wing 30–36 into which a respective magnet 38–44 may be placed.

Preferably there are four magnets 38, 40, 42, 44, placed as shown are described, but there may be a greater or smaller number of magnets provided that the magnets are laterally spaced outward of the jaws or prongs.

It is to be understood that the present invention is not limited to the embodiments described above, but encompasses any and all embodiments within the scope of the following claims.

I claim:

1. A staple remover, comprising a first channel member, with a front end from which prongs extend, and a rear end;

a second channel member, smaller in width than the first channel member, with a front end from which prongs extend toward the prongs of the first channel member, and a rear end pivotally attached to the rear end of the first channel member, so that the second channel member fits inside the first channel member, and the channel members can move between an open position in which the prongs are separated, to a closed position in which the prongs overlap;

a first supporting member attached to the first channel member; and a second supporting member attached to the second channel member, wherein there are wings extending from the left and right sides of each supporting member, and there is at least one magnet attached to each wing.

2. The staple remover according to claim 1 wherein there are exactly four magnets, exactly one of which is attached to each of the wings of each of the first supporting member and the second supporting member.

3. The staple remover according to claim 2 wherein the magnets are disk shaped, are inserted into a cylindrical recesses defined in each of the wings, and are attached thereto with an adhesive material.

4. The staple remover according to claim 3, including a spring that surrounds a cylindrical pivot by which the first channel member is attached to the second channel member, the spring having a first end engaging the first channel member, and a second end engaging the second channel member, by which the channel members are biased towards the open position.

5. A staple remover, comprising:

a first channel member, with a front end from which prongs extend, and a rear end;

a second channel member, smaller in width than the first channel member, with a front end from which prongs extend towards the prongs of the first channel member, and a rear end pivotally attached to the rear end of the first channel member, so that the second channel member fits inside the first channel member, and the channel members can move between an open position in which the prongs are separated, to a closed position in which the prongs overlap;

a first supporting member, attached to the first channel member, with at least two magnets attached to the first supporting member; and a second supporting member, attached to the second channel member.

6. A staple remover, comprising:

a first channel member having a first prong, and a second prong laterally spaced from the first prong, the first prong and the second prong formed at a first end of the first channel member;

a second channel member having a first prong formed at a first end of the second channel member, the first prong of the second channel member in opposed relation to the first prong and the second prong of the first channel member, the first and second channel members movable between an open position in which the first prong and the second prong of the first channel member are spaced relatively apart from the first prong of the second channel member and a closed position in which the first prong and the second prong of the first channel member overlap the first prong of the second channel member; and a first magnet coupled to the first channel member for movement therewith, the first magnet spaced laterally outward of the first channel member and proximate the first prong thereof.

7. The staple remover of claim 6, further comprising:

a first supporting member attached to the first channel member wherein the first magnet is attached to the first supporting member and coupled to the first channel member by way of the first supporting member.

8. The staple remover of claim 6, further comprising:

a second magnet coupled to the first channel member for movement therewith, the second magnet spaced laterally outward of the first channel member and proximate the second prong thereof.

9. The staple remover of claim 8, further comprising:

a first supporting member attached to the first channel member wherein the first magnet and the second magnet are each attached to the first supporting member and coupled to the first channel member by way of the first supporting member.

10. The staple remover of claim 6, further comprising:

a second prong formed at the first end of the second channel member, the second prong of the second channel member being laterally spaced from the first prong of the second channel member; and a second magnet coupled to the second channel member for movement therewith, the second magnet spaced laterally outward of the second channel member and proximate the first prong thereof.

11. The staple remover of claim 10, further comprising:

a first supporting member attached to the first channel member wherein the first magnet is attached to the first supporting member and coupled to the first channel member by way of the first supporting member; and a second supporting member attached to the second channel member wherein the second magnet is attached to the second supporting member and coupled to the second channel member by way of the second supporting member.

12. The staple remover of claim 10, further comprising:

a third magnet coupled to the first channel member for movement therewith, the third magnet spaced laterally outward of the first channel member and proximate the second prong thereof.

13. The staple remover of claim 12, further comprising:

a first supporting member attached to the first channel member wherein the first magnet and the third magnet are each attached to the first supporting member and coupled to the first channel member by way of the first supporting member; and a second supporting member attached to the second channel member wherein the second magnet is attached to the second supporting member and coupled to the second channel member by way of the second supporting member.

14. The staple remover of claim 12, further comprising:

a fourth magnet coupled to the second channel member for movement therewith, the fourth magnet spaced laterally outward of the second channel member and proximate the second prong thereof.

15. The staple remover of claim 14, further comprising:

a first supporting member attached to the first channel member wherein the first magnet and the third magnet are each attached to the first supporting member and coupled to the first channel member by way of the first supporting member; and a second supporting member attached to the second channel member wherein the second magnet and the fourth magnet are each attached to the second supporting member and coupled to the second channel member by way of the second supporting member.

16. The staple remover of claim 1 wherein each of the at least one magnet attached to the first supporting member is spaced laterally outside of the first channel member.

17. The staple remover of claim 1 wherein each of the at least one magnet attached to the second supporting member is spaced laterally outside of the second channel member.

18. The staple remover of claim 6 wherein each magnet is spaced laterally outside of the first channel member and the second channel member.

19. The staple remover of claim 6, wherein the first channel member is smaller in width than the second channel member so that the first channel member fits inside the second channel member.

20. The staple remover of claim 6, wherein the second channel member is smaller in width than the first channel member so that the second channel member fits inside the first channel member.

* * * * *